US006623002B1

(12) United States Patent
Auerbach

(10) Patent No.: US 6,623,002 B1
(45) Date of Patent: Sep. 23, 2003

(54) FLAT ARTICLE TRANSPORT AND ALIGNER SYSTEM

(75) Inventor: David R Auerbach, West Redding, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/209,016

(22) Filed: Jul. 31, 2002

Related U.S. Application Data

(60) Provisional application No. 60/388,945, filed on Jun. 13, 2002.

(51) Int. Cl.[7] ..... B65H 5/06

(52) U.S. Cl. ..... 271/223; 271/184; 271/185; 209/900; 198/406; 198/407

(58) Field of Search ..... 271/184, 185, 271/225, 2; 198/405, 406, 407, 412; 209/584, 900

(56) References Cited

U.S. PATENT DOCUMENTS

| | | | | | |
|---|---|---|---|---|---|
| 2,961,085 | A | * | 11/1960 | Stovall | 198/382 |
| 3,934,717 | A | * | 1/1976 | Katagiri et al. | 198/416 |
| 4,012,033 | A | * | 3/1977 | Parrish, II | 271/302 |
| 4,099,712 | A | * | 7/1978 | Martin | 271/184 |
| 4,618,136 | A | * | 10/1986 | Pessina et al. | 271/150 |
| 4,884,793 | A | * | 12/1989 | Hurst | 271/2 |
| 5,180,154 | A | | 1/1993 | Malick | 271/2 |
| 5,180,159 | A | | 1/1993 | Malick | 271/225 |
| 5,368,287 | A | | 11/1994 | Belec | 271/185 |
| 5,411,250 | A | | 5/1995 | Belec et al. | 271/185 |
| 5,412,385 | A | * | 5/1995 | Mangelsdorf | 341/120 |
| 5,429,249 | A | | 7/1995 | Belec et al. | 209/584 |
| 5,449,159 | A | | 9/1995 | Belec et al. | 271/2 |
| 5,538,239 | A | | 7/1996 | Auerbach et al. | 271/225 |
| 5,582,087 | A | * | 12/1996 | Crowley et al. | 83/155 |
| 5,960,963 | A | | 10/1999 | Chodack et al. | 209/657 |
| 5,971,161 | A | | 10/1999 | Branecky et al. | 209/657 |
| 6,032,784 | A | * | 3/2000 | Bellanca et al. | 198/406 |
| 6,102,391 | A | | 8/2000 | Malick et al. | 271/225 |

* cited by examiner

*Primary Examiner*—Donald P. Walsh
*Assistant Examiner*—Kaitlin Joerger
(74) *Attorney, Agent, or Firm*—Michael J. Cummings; Charles R. Malandra, Jr.; Angelo N. Chaclas

(57) ABSTRACT

An apparatus for changing the redirecting the path of a flat article transported in an article processing system. A transport including a ramp that can raise the elevation of vertically oriented envelopes from a first level to a second level, and maintaining the alignment and orientation of transported envelopes square with the direction of travel. The transport comprised of nips which act to drive and orient the envelopes in the direction of travel. Sets of these nips comprising a driven roller and an idler roller. The idler roller has a toroidally shaped outer surface biased against the driven roller. The nips operate to allow the transported articles to pivot and maintain alignment in the travel direction as they are driven forward. In an alternative embodiment, the invention can be used to transport horizontal envelopes and alter the path of horizontal envelopes while maintaining the orientation of the envelopes in the direction of travel.

6 Claims, 4 Drawing Sheets

1
2
3
4
5
6
7
10
11
13
14
15
15'
16
17
18
19
20
21
23
24
25
26
27
28
30
40
41
42
43
44

FLAT ARTICLE TRANSPORT AND ALIGNER SYSTEM

This application claims the benefit of provisional application No. 60/388,945, filed Jun. 13, 2002.

TECHNICAL FIELD

The present invention relates to a device for transporting and aligning flat articles in an article processing system, typically a mail processing system. The device redirects and realigns transported flat articles in a path from a first direction to second parallel direction.

BACKGROUND OF THE INVENTION

Mail processing and insertion systems such as those applicable for use with the present invention, are typically used by organizations such as banks, insurance companies and utility companies for producing a large volume of specific mailings where the contents of each mail item are directed to a particular addressee. Also, other organizations, such as direct mailers, use inserters for producing a large volume of generic mailings where the contents of each mail item are substantially identical for each addressee. Examples of such inserter systems are the 8 series and 9 series inserter systems available from Pitney Bowes Inc. of Stamford Conn.

In many respects, the typical inserter system resembles a manufacturing assembly line. Sheets and other raw materials (other sheets, enclosures, and envelopes) enter the inserter system as inputs. A plurality of different modules in the inserter system work cooperatively to process the sheets to produce a finished mail piece. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

In designing a mail processing system, as described above, it is important to take into consideration various space and ergonomic considerations. A first consideration is the size of a room for housing the inserting system. While an inserting system that has a straight processing path might often be efficient, the number and size of the processing modules might be such that the customer does not have enough room in their facility to accommodate the length in a single dimension. Accordingly, it is known in the art that it may be necessary to provide a turning module, typically at a right angle, to shorten the system's length in any one dimension. The choice or the nature and location of the turning module may be difficult, because turning may introduce additional complexity and error into the system. It is also preferable that a turning module be made to do something useful during the turning process, and that floor space and machinery not be used solely for changing the direction of the processing path.

Another consideration in assembling a mail processing system is ergonomics. Even if a customer has room for a straight system, the distance between the beginning and the end of the system might be so great as to make it difficult for an operator to effectively attend to the whole machine. Accordingly, right angle turn modules have been found to be advantageous to create "L" shaped or "U" shaped arrangements to create a work area in which operators have easier access to all of the modules.

Another ergonomic consideration is the height of various components and transports in the system. In the modules where inserts are being fed into collations of documents, operators must have access to feeders in order to refill them and to correct jams. As such, the feeders are typically placed at a level for attendants' hands to have easy access. As a result, the transport and collations of documents are somewhat below. At an output sorting station, stacks of finished mail pieces are sorted into bins according to zip codes and postal regulations. The sorting bins are periodically hand unloaded by operators. Thus, the bins are typically placed at hand working level. As such, collations and envelopes that are processed upstream, below hand level, must elevated before the sorting stage and sorting bins.

Current mail processing machines are often required to process up to 18,000 pieces of mail an hour, and envelopes travel at speeds as high as 100 inches per second as they are being processed. The steps of moistening and sealing the envelope flaps in particular may result in problems at those speeds. Envelopes may be moving so fast that glue on a moistened envelope flap may not have time form a seal before it is subjected to further processing. Such further processing may cause the envelope flap to reopen partially or fully before the proper sealing can occur. In addition to making the envelope unsuitable for mailing, re-opened flaps can cause jamming of the system.

At such high speeds it is also important to maintain envelopes in their appropriate orientations so that they may be properly handled when they arrive at their respective processing stations. Similarly, it is important to maintain an appropriate gap between subsequent envelopes so that they do not catch up to one another and cause jams. At higher speeds, the mail processing systems become much less tolerant of orientation and spacing errors that can result in jamming and damage to mail pieces.

SUMMARY OF THE INVENTION

The present invention provides a transport mechanism preferably for use in an inserter system as described above. In a preferred first embodiment, the transport provides a ramp that can raise the elevation of vertically oriented envelopes from a first level to a second level. During and after the elevating process, the transport operates to maintain the alignment and orientation of transported envelopes square with the direction of travel.

In this preferred first embodiment, the transport comprises sets of special nips that act to drive and orient the envelopes in the direction of travel. Each set of these nips comprises a driven roller and an idler roller. The idler roller has a toroidally shaped outer surface biased against the driven roller. The transport path of transported envelopes passes between the driven roller and the idler roller.

A first set of nips are positioned to provide a horizontal driving force on the vertically oriented envelopes. Upon entering the ramp portion of the transport path, the top and bottom edges of transported envelopes are aligned substantially parallel with the direction of travel. Immediately downstream of the first set of nips, a second set of angled ramp provides a driving force angled upwards (or downwards, as the case may be) from the horizontal transport direction.

When the envelope is under the control of the first and second sets of nips, a front portion of the envelope is being driven in the angled direction, while a rear portion continues to be driven in the horizontal direction. Because the toroidal idler nip and the driven nip grip the envelope at a relatively small point of contact, the envelope is allowed to pivot in both the first and second nips. As the envelope makes the transition between the horizontal and angled nips, the envelope gradually pivots from the horizontal position to the angled position. Thus, the first and second sets of ramp nips cooperate to drive and pivot the vertically oriented envelopes within the vertical plane of the transport path to align the top and bottom edges of the envelopes substantially parallel with an angle of the angled ramp nips.

At the end of the ramped portion of the transport, a third set of nips is also angled in the ramped direction. A forth set of nips immediately downstream from the third set of nips is angled horizontally drive the envelopes horizontally at their new elevation. The third and fourth sets of nips cooperate similarly as described above to allow the envelope to pivot from its ramped direction to its horizontal direction. Thus, the elevation of a vertically transported envelope has been changed, and the orientation of the envelope within the path of travel has been maintained.

In an alternative embodiment, utilizing the same principles as the transport for adjusting the path of a vertically oriented envelope, the path for a horizontally transported envelope can be altered in the horizontal plane. Such an arrangement could be advantageous where it is desirable to switch the registration of the envelope in the transport path from a top edge to a bottom edge of the envelope, or vice-versa. For example, an operation such as printing a postage indicia usually occurs on an envelope that is top-registered in the transport path. A downstream process, such as printing a bar-code along a bottom edge of the envelope might require that the envelopes be bottom registered. Thus the present invention could be used to alter the path of the envelopes lateral to the transport direction in order to achieve the desired shift in registration from one side of the envelope to another.

Further features and preferred embodiments are described in the specification, claims, and figures.

DETAILED DESCRIPTION

This patent application is related to co-pending application Ser. No. 10/209,016 titled Envelope Transport Turn Module and Ramp for an Output Portion of an Inserter System, filed concurrently herewith.

The present invention is preferably used to elevate finished mail pieces prior to an output sorting module at the end of a high speed mail processing inserter system. Examples of suitable mail piece sorting modules are described in U.S. Pat. Nos. 5,971,161, 5,960,963, 5,449,159, 5,429,249, 5,411,250 and 5,368,287, assigned to the assignee of the present application, each of which is hereby incorporated by reference.

Figure 1:
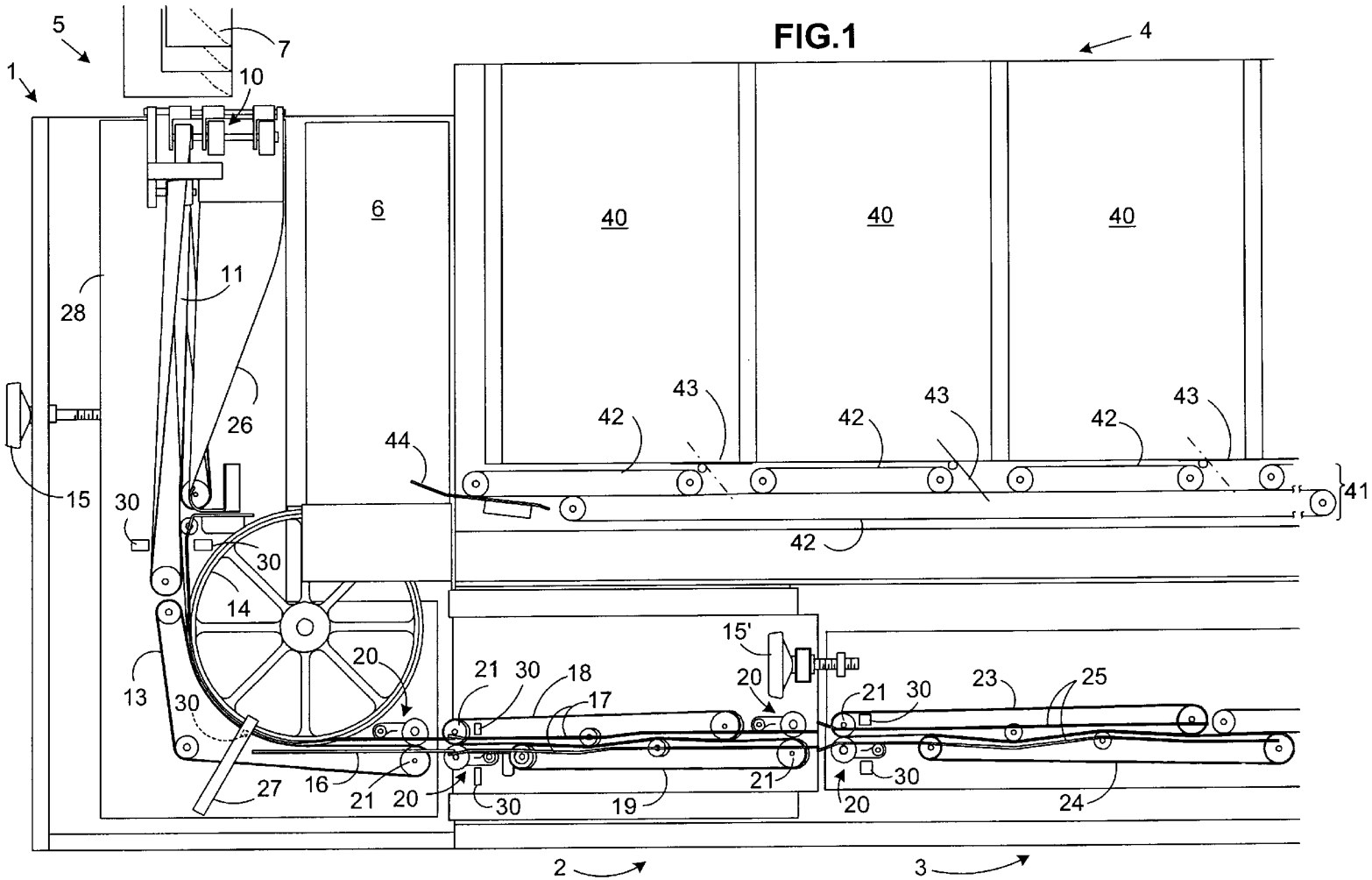
FIG. 1 is a top view of an apparatus for use with the present invention.
Figure 2:
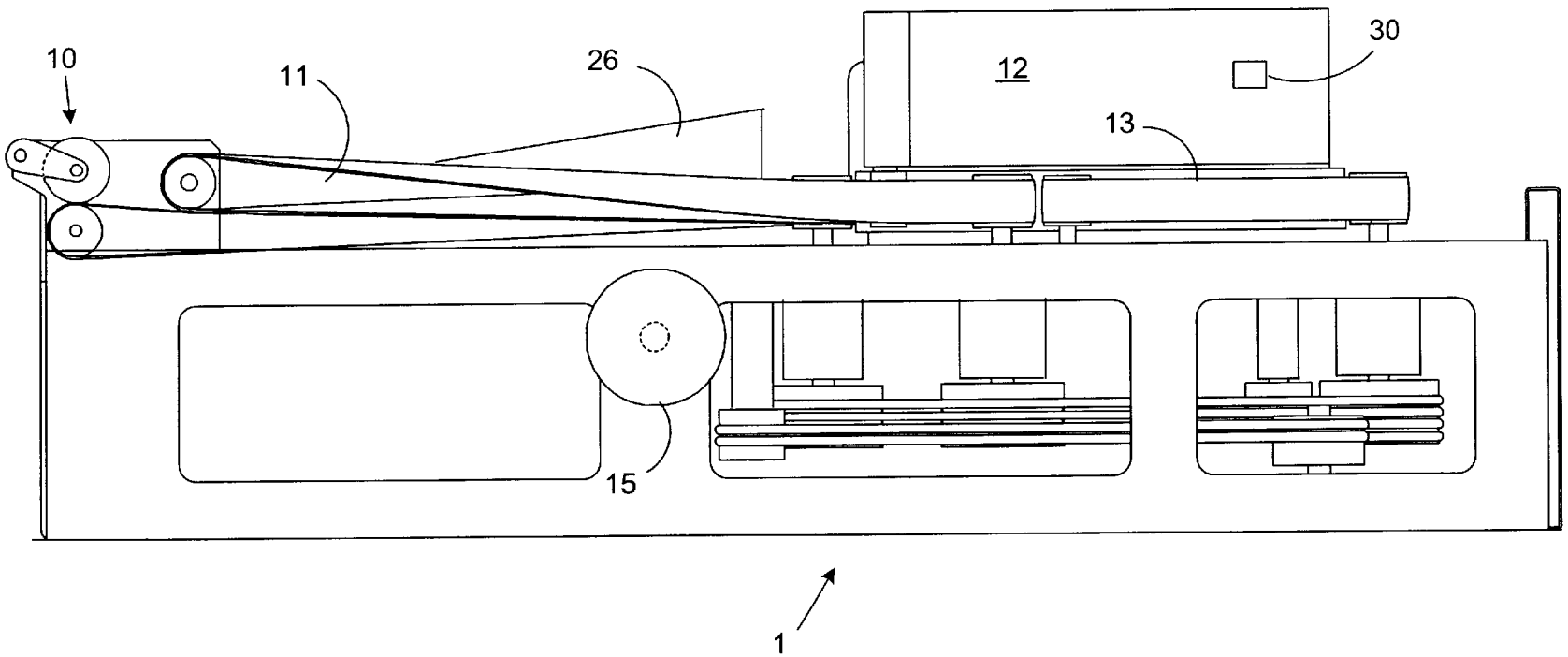
FIG. 2 is a front view of the apparatus for use with the present invention.
Figure 3:
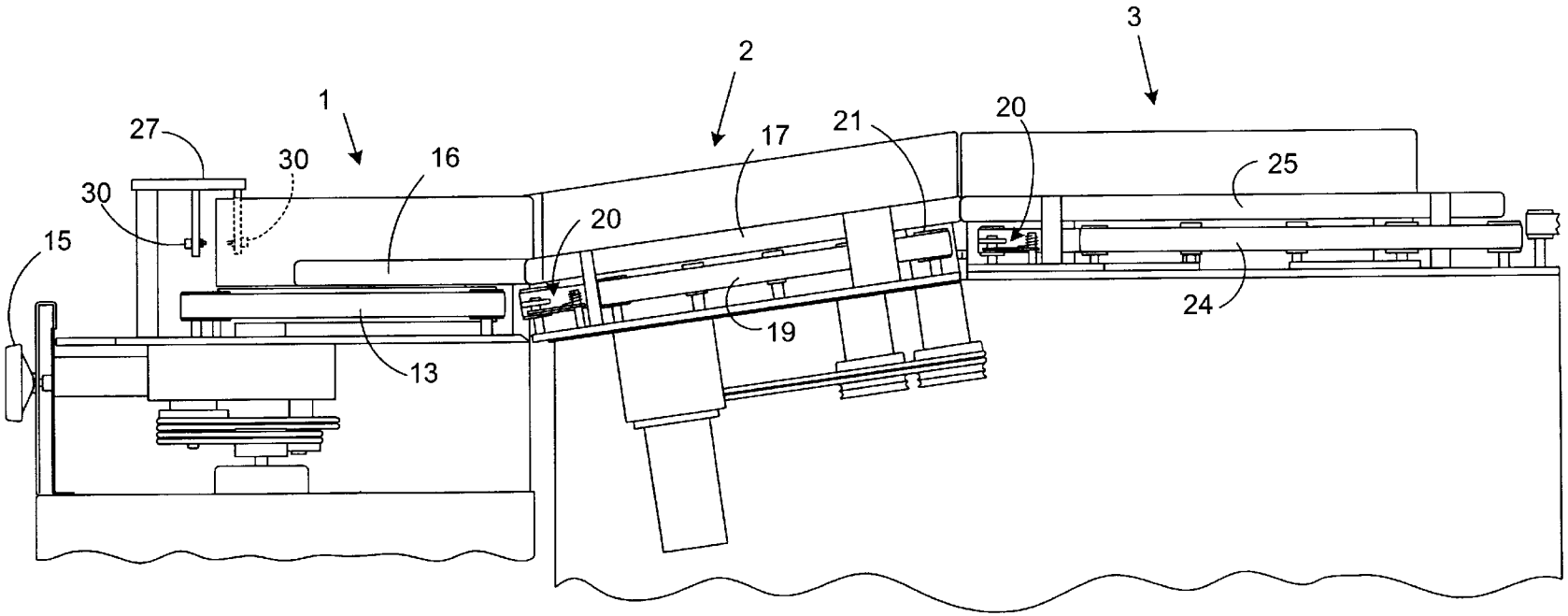
FIG. 3 is a side view of the apparatus for use with the present invention.

Referring to FIGS. 1, 2 and 3 components and features of an exemplary embodiment incorporating the present invention may be observed. Major modules of the system comprise a ninety degree turn module 1, a ramp module 2, a 180 degree transport module 3, and a sorting module 4.

The turn module 1, receives envelopes 7 from an upstream module transport 5. The envelopes 7 are received in a horizontal orientation, with the face of the envelope up, and the flap side of the envelope down.

The envelopes 7 are received into turn module 1 via input rollers 10. From the input rollers 10, the envelopes are transferred to input nips for a twisted belt pair 11. Twisted belt pairs are transport mechanisms known in the art for transporting and reorienting envelopes from a horizontal to a vertical orientation (or vice versa).

The twisted belt pair 11 will grip the transported envelopes along a bottom portion of the envelope, so as not to interfere with the flap of the envelope. As the envelopes are transported by the twisted belt pair 11, a torsion force is applied to change the orientation from horizontal to vertical, and to bring the envelope into an upright position. While traveling in the twisted belt pair 11, an upper portion of the envelope may receive guiding and support from a horizontal-to-vertical guide 26. Guide 26 may comprise a guide bar or a piece of twisted material that runs parallel the transport path of the twisted belt pair 11. The guide 26 may serve to assist in keeping the envelope flaps shut during the stress of reorienting the envelope.

In order that the twisted belt pair 11 can properly grip the bottom portions of envelopes of varying sizes, the input end of the twisted belt pair may be adjusted in a direction perpendicular to the transport path, as will be discussed in more detail below.

At a downstream end of the twisted belt pair 11, the vertically oriented envelopes enter a turning arrangement. The turning arrangement preferably transports the envelopes in a new direction perpendicular to their original direction. In the preferred embodiment, the transport for the turning arrangement is driven by turn belt 13. A length of turn belt 13 is positioned such that it is urged against a portion of the circumference of turn wheel 14, positioned contiguous with the transport path. In the preferred embodiment, turn wheel 14 is an idler roller that is turned by the force of the length of the driven turn belt 13 that is pressed against the portion of its circumference. Vertically oriented envelopes received by the turning arrangement are gripped between the turn belt 13 and the turn wheel 14 as it is transported around ninety degrees of the circumference of the turn wheel 14.

Turn belt 13 and turn wheel 14 are preferably of approximate equal height, sufficient to grip a lower portion of the envelope between them, preferably between one and two inches high. By gripping just a lower portion of the envelope, turn belt 13 and turn wheel 14 do not place direct bending strain on the envelope flap as the envelope makes the turn. However, the necessary transport force is provided to move the envelopes through the module.

As the envelopes make the change of direction in the turning arrangement, the preferred embodiment of the present invention utilizes a turning guide 12. The turning guide 12 is comprised of a smooth curved surface extending vertically upward along the side of the transport path interior to the turn radius of the transport path formed by belt 13 and wheel 14. A portion of turning guide 12 disposed above the interface of belt 13 and wheel 14 provides support to for the upper portion of envelopes passing through the turn. Such vertical support helps to prevent bending or distortion of the envelopes that might occur while being gripped and turned by the forces acting upon their lower portions. Also, the support provided by turn guide 12 keeps the envelope flaps closed to aid in proper sealing. In the preferred embodiment, the radius of the curved portion of the turning guide 12 is just slightly less than the radius of the wheel 14.

After the envelopes have completed their change of direction in the turning arrangement, they continue to be transported in the vertical position by series of rollers and belts. Above the rollers and belts, the envelopes receive support from transport guides 16 and 17, which continue the guiding function in holding the envelopes upright, and providing support for the envelope flaps.

In accordance with the present invention, shortly upon leaving the turning arrangement, the envelopes are transferred from turn module 1 to the ramp module 2. The purpose of ramp module 2 is to raise the envelopes from a lower elevation, at which they were processed earlier in the system, to a higher elevation used by the output sorting module 4. There is no mechanical requirement that the output sorting process occur at a higher elevation than earlier processing. However, since the sorting includes bins 40 that have a downward slant, and because upstream automated processing generally occurs at a level lower than a comfortable working level for human workers, it is desirable from an ergonomics perspective to raise the envelopes for the output sorting stage. Typically the envelopes may be raised by a height of two or three inches. For such elevation changes, the ramp module 2 is preferably inclined at an angle of approximately eight degrees.

The input and output portions of the transports for the turn module 1 and the ramp module 2 have particular configurations of rollers and belts to maintain the registration of the bottom of the envelopes substantially parallel to the path of travel, even on the ramp and after the ramp. This is desirable so that envelopes do not become too tilted relative to the travel direction. Downstream, such tilting may have the effect of causing jams as the envelopes are processed by the sorting mechanisms.

For much of the length of the ramp module 2 the envelope is transported between belts 18 and 19, with an upper portion of the envelope guided by guides 17. Similarly for an initial linear portion of transport module 3 the envelope is transported between belts 23 and 24, with an upper portion of the envelope guided by guides 25. The transport guide pairs 17 and 25 may be comprised of guides that are different heights on the opposite sides of the feed path. In the preferred embodiment, an interior guide 17 or 25, of a pair is taller, and has a height substantially the same as the turning guide 12. The taller guide provides support on the flap side of transported envelopes for continued prevention of opening of the flap before a seal can be formed.

In transferring envelopes from the turning module 1 to the ramp module 2, and from the ramp module 2 to the transport module 3, alignment of the envelopes with the transport path is maintained by specially designed sets of nips comprised of rollers 20 and 21 at the interface of those transports. Roller 21 may be a driven roller at the transition end of a transport belt 13, 18, 19, or 23, as shown in FIG. 1. Roller 21 is driven along with its respective transport belt.

Figure 4A:
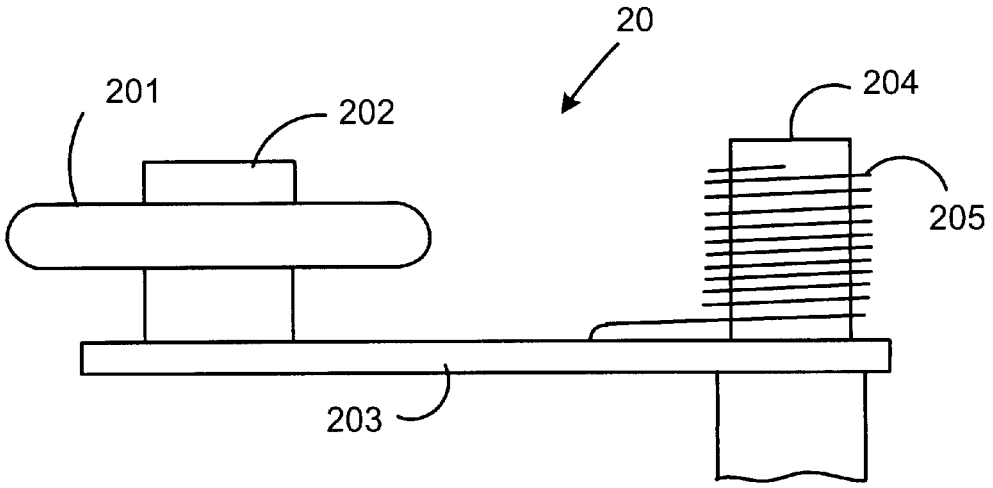
FIGS. 4*a* and 4*b* are a side and top views of a toroidal idler roller included in the preferred embodiment of the present invention.
Figure 4B:
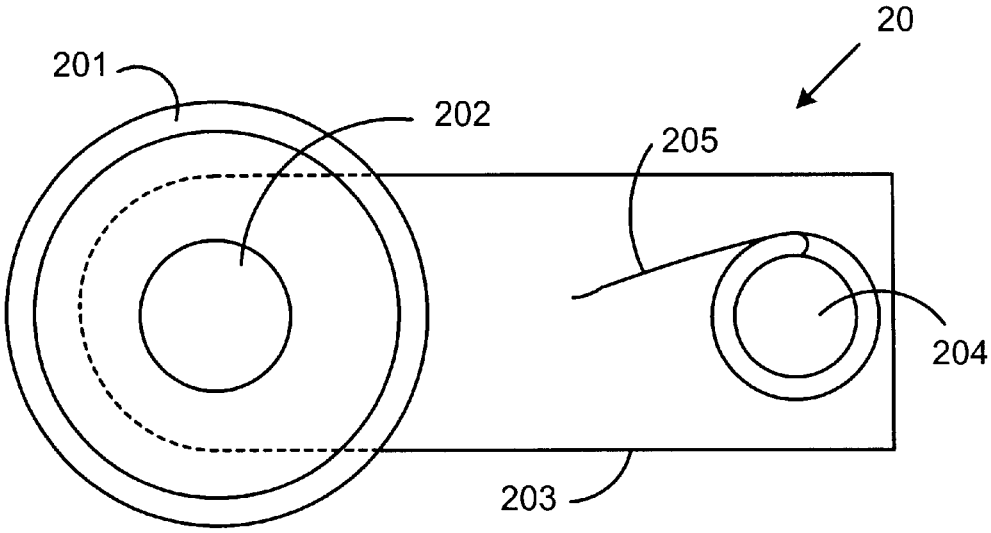

Opposite roller 21 is idler roller assembly 20, the preferred embodiment of which is depicted in FIG. 4. The idler roller assembly is comprised of a toroidal roller wheel 201 rotatably mounted on a shaft 202 mounted on an arm 203. Arm 203 pivots on base shaft 204. The toroidal wheel 201 is spring biased against roller 21 by the spring 205 providing angular tension between the arm 203 and the base shaft 204.

The toroidal shape of the wheel 201 results in a relatively small point of contact between the toroidal wheel 201 and the driven roller 21. The small point of contact on the curved outer diameter of the toriodal wheel 201 provides a moving pivot point around which the envelope may turn as the transport direction changes. Thus when a forward portion of an envelope driven between roller 21 and idler roller 20 is pulled in a direction with an angular vector different than its current direction, the envelope can pivot at the point between those rollers to adjust to the new vector while it continues to be driven forward with the same forward vector. To reduce frictional forces on envelopes between rollers 20 and 21 even more, in a preferred embodiment, the driven roller 21 may also have a somewhat curved outer surface to further reduce the friction creating surface area of the nip rollers on the envelope.

In practice, as an envelope reaches the output of turn module 1, the first set of nips 20 and 21 at that location are in a horizontal orientation and will continue to drive the envelope in the horizontal direction. However, when the lead edge of the envelope reaches the angled set of second nips 20 and 21 at the beginning of ramp module 2, then the lead edge of the envelope is urged upward in the angled direction. The envelope pivots upward at both the first and second set of nips as control is transferred to the ramped transport system and belts 18 and 19. Once the envelope comes under the full control of ramp module 2 the envelope has pivoted such that it is angled at substantially the same direction as the ramped transport direction.

The same process occurs in reverse as the envelope changes from an angled direction of travel to once again traveling in a horizontal direction at the transition from ramp module 2 to horizontal transport module 3.

If the first set of nips were conventional rollers with flat surfaces, the frictional forces of the nips during a transition to or from ramp module 2 would prevent pivoting. As a result, conflicting vector forces acting on the envelope could cause it to buckle and/or jam. Even if slippage in the nips prevents damage to the envelopes, when the envelope comes under the full control of the ramp transport 3, it will no longer be oriented squarely in the transport direction. This is the situation which is avoided with the preferred embodiment of the present invention. An envelope that is too far askew in the transport cannot be properly processed by sorting module 4.

In an alternative embodiment, the principles utilized in redirecting and reorienting envelopes in ramp module 2 can be applied to a transport carrying horizontal envelopes, or other flat articles. As such, envelopes traveling in a first horizontal direction will be redirected by the sets of nips comprised of a driven roller 21 and an idler roller 20, but in a horizontal orientation. The transition between the sets of nips causes transported nips to be redirected in a second horizontal direction at an angle from the first horizontal direction. At the end of the angled portion of the horizontal transport path, the envelope is returned to a transport path parallel to the first transport path, by two more sets of the combination of rollers 20 and 21. In essence, the functional features of ramp module 2 can be laid on their sides for achieving this kind of transport.

Altering the transport of envelopes in the horizontal arrangement, could be advantageous when it is desirable to switch the registration of the envelope in the transport path from a top edge to a bottom edge of the envelope, or vice-versa. For example, an operation such as printing a postage indicia usually occurs on an envelope that is top-registered in the transport path. A downstream process, such as printing a bar-code along a bottom portion of the envelope might require that the envelopes be bottom registered. Thus the present invention could be used to alter the path of the envelopes lateral to the transport direction in order to achieve the desired shift in registration from one side of the envelope to another.

An apparatus utilizing the preferred vertical transport aspect of the present invention can be adjusted to receive and process envelopes of different sizes. A first location that is sensitive to different envelope sizes is the input rollers 10 at the input to turn module 1. As discussed previously, the twisted belt pair 11, and other downstream vertical transport devices grip a lower portion of the envelopes. Because the envelopes 7 typically arrive at the turn module 1 with their top edges registered along a common border, variance in the sizes of the envelopes results in different locations for their lower portions relative to the turn module 1. Accordingly, as can be seen in FIG. 1, it is desirable that the input rollers 10, and the corresponding beginning of the twisted belt pair be adjustable laterally to the transport direction of the envelopes. Such adjustment would typically only be necessary when starting a new mail production job using different sized envelopes.

As seen in FIG. 1, the input rollers 10 and twisted belt pair 11 are mounted on a base 28 which is laterally movable relative to the frame of the turn module 1. The lateral position of the base 28 is adjusted by turning adjusting mechanism 15. In the preferred embodiment, the adjusting mechanism includes a threaded shaft rotatably and fixedly mounted to the frame of turn module 1. When the adjusting mechanism 15 is turned, a screw interface with base 28 causes the base to move a desired amount to a position where the input roller 10 grip the lower portion of the envelopes at the standard predetermined position.

Base 28 also preferably supports the turning arrangement comprised of the wheel 14 and turning belt 13. Thus, simultaneously with adjusting the position of input rollers 10, the same motion can adjust a gap in the transport path between the turn module 1 and ramp module 2. By making the appropriate adjustment, more space will be provided for larger envelopes to make the transition in the turn upward onto ramp module 2.

To allow a similar adjustment to be made at the transition from the ramp module 2 to transport module 3, another adjustment mechanism 15' may be provided between those two modules. In an exemplary embodiment, the adjustment mechanism may again be a threaded turnscrew mechanism, with one end fixedly mounted on ramp module 2 and the other end attached though a threaded interface to a movable base in the transport module 3. In practice, using the preferred embodiment, it has been found that the second adjustment mechanism 15' is not necessary, and that the resulting error in positioning as a result of not adjusting for different envelope sizes is not so great as to affect the downstream sorting process. However for use with different downstream processing, less error may be tolerated, and adjustment mechanism 15' may be necessary.

After the envelopes are (1) reoriented from horizontal to vertical, (2) redirected by ninety degrees, and (3) elevated by several inches, the transport module 3 reverses the direction of the transport path by 180 degrees to perform the sorting process in sorting module 4. Sorting module 4 is located to the side of ramp module 2 and transport module 3 that is closer to the inserter system modules upstream of the turn module 1. In this way an inserter system with an "L" or "U" shaped footprint can be formed, with the interior of the "L" or "U" serving as the workspace for operators. Workers may attend to upstream modules while being able to observe the operation of the sorting module 4. Also when it comes time to empty the bins 40 of the stacks of processed mail, the operators may perform that task without having to walk too far from the other stations on the inserter machine.

During the sorting process envelopes are transported on the sort transport 41 comprised of a series of belts 42 between which envelopes are transported. At various intervals in the sort transport 41, deflectors 43 open to deflect the envelopes into the appropriate sort bins 40.

If an envelope cannot be sorted properly into any of the sort bins 40, whether an error has occurred, or special handling is required, it is deposited into an outsort bin 6 at the end of the sort transport 41. An outsort guide 44 guides mail pieces into the outsort bin 6 in an orderly fashion.

A potential advantage of the system depicted in FIG. 1, is that the outsort bin 6 can be mounted in turn module 1. As discussed previously, floor space for inserter systems is often at a premium, and the greater the amount of functionality that can be achieved in a shorter distance, the better. The arrangement depicted in FIG. 1, shows that the turn module 1 can provide space for the outsort bin 6, along the side, and elevated from, the twisted belt pair 11. By placing the outsort bin 6 at that location, the overall length of the sorting module 4 can be shortened, and greater efficiency is achieved and floor space saved.

Although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A ramp aligner transport apparatus for transporting vertically oriented flat rectangular articles from a first height to a second height along a transport path having a vertical plane, the transport comprising:

sets of ramp nips, a set of ramp nips comprising a driven roller and an idler roller with a toroidally shaped outer surface biased against the driven roller, the transport path passing between the driven roller and the idler roller;

a first set of horizontal ramp nips transporting vertically oriented articles in the transport path, a top edge and a bottom edge of the articles aligned substantially parallel with the direction of travel;

a second set of angled ramp nips downstream from the first set of ramp nips, the first and second sets of ramp nips cooperating to drive and pivot the vertically oriented articles within the vertical plane of the transport path to align the top and bottom edges of the articles substantially parallel with an angle of the angled ramp nips.

2. The transport of claim 1 further comprising:

a third set of angled ramp nips downstream from the second set of angled ramp nips, and at an end of a ramped portion of the transport path;

a fourth set of horizontal ramp nips downstream of the third set of ramp nips, the third and fourth sets of ramp nips cooperating to drive and pivot the vertically oriented articles within the vertical plane of the transport path to align the top and bottom edges of the articles substantially horizontal as the articles are driven past the fourth set of nips.

3. The transport of claim 2 wherein the angled ramp nips are at an upward angle of substantially seven to ten degrees.

4. The transport of claim 3 wherein the third set of ramp nips is elevated two to four inches higher than the second set of ramp nips.

5. An aligner transport apparatus for transporting and aligning horizontally oriented flat rectangular articles in a transport path having a horizontal plane, the transport comprising:

sets of aligner nips, a set of aligner nips comprises a driven roller and an idler roller with a toroidally shaped outer surface biased against the driven roller, the transport path passing between the driven roller and the idler roller;

a first set of aligner nips driving horizontally oriented articles in a first direction in the transport path, a top edge and a bottom edge of the articles aligned parallel with the first direction;

a second set of angled aligner nips downstream from the first set of aligner nips, the second set of angled aligner nips driving articles in a second direction at an angle from the first direction in the horizontal plane, the first and second sets of aligner nips cooperating to drive and pivot the articles within the horizontal plane of the transport path to align the top and bottom edges of the articles substantially parallel with the angle of the angled aligner nips.

6. The transport of claim 5 further comprising:

a third set of angled aligner nips downstream from the second set of angled aligner nips, and at an end of an angled portion of the transport path; and a fourth set of aligner nips downstream of the third set of angled aligner nips and driving articles in a third direction parallel to the first direction, the third and fourth sets of aligner nips cooperating to drive and pivot the horizontally oriented articles within the horizontal plane of the transport path to align the top and bottom edges of the articles substantially parallel to the third direction as the articles are driven past the fourth set of nips.

* * * * *